US005552661A

United States Patent [19]

Lee

[11] Patent Number: 5,552,661

[45] Date of Patent: Sep. 3, 1996

[54] ELECTRON GUN FOR CATHODE TUBE

[75] Inventor: Gyeong S. Lee, Seoul, Rep. of Korea

[73] Assignee: Goldstar Co., Ltd., Seoul, Rep. of Korea

[21] Appl. No.: 279,601

[22] Filed: Jul. 25, 1994

[30] Foreign Application Priority Data

Jul. 26, 1993 [KR] Rep. of Korea ..... 1993-14199

[51] Int. Cl.[6] ..... H01J 29/04

[52] U.S. Cl. ..... 313/346 R; 313/446; 313/337

[58] Field of Search ..... 313/446, 270, 313/302, 337, 346 R, 346 DC

[56] References Cited

U.S. PATENT DOCUMENTS

| | | | |
|---|---|---|---|
| 3,569,768 | 3/1971 | Benda | 313/337 |
| 4,165,473 | 8/1979 | Falce | 313/337 |
| 4,554,480 | 11/1985 | Schlack | 313/446 |
| 4,782,263 | 11/1988 | Schlack et al. | 313/337 |
| 4,797,593 | 1/1989 | Saito et al. | 313/346 R |

*Primary Examiner*—Sandra L. O'Shea
*Assistant Examiner*—Vip Patel
*Attorney, Agent, or Firm*—Spencer & Frank

[57] ABSTRACT

This invention relates to an electron gun for cathode tube having red, green and blue cathode structure body composed of a combination with a sleeve having open and close type and other length, thickness, shape and the quality of material and connecting heater therein, a base metal having other shape, thickness and attached on upper edge of the sleeve and a hot electron emitting material deposited on the base metal.

10 Claims, 4 Drawing Sheets

ELECTRON GUN FOR CATHODE TUBE

FIELD OF THE INVENTION

Background of the Invention

This invention relates to electron gun of cathode tube, more particularly relates to electron gun of cathode tube for producing faster a picture on screen in green cathode structure body than that of red and blue cathode structure bodies.

BACKGROUND OF THE INVENTION

Generally, a certain picture on the screen are played by selctive luminescence, when electron beam from electron gun of cathode tube is incident to red, green and blue fluorescent materials arranged in sequence as a stripe or dot type.

Referring to FIG. 1, there is illustrated a general cathode tube.

As shown in FIG. 1, the cathode tube includes neck part(N) which has electron gun in the inside for radiating the electron beam to fluorescent materials, Funnel(N) which is connected with said neck part(N) and is deposited to inner and outer sunface with black lead and Pannel(P) which is connected with said Funnel, deposited with fluorescent material and jointed with shadow mask for passing electron beam selectively.

Black matrix and metal-back are deposited to said fluorescent material. The black Matrix is to increase a luminance and the Metal-back is to increase a contrast.

The cathode tube further includes a deflection Yoke(D) for deflecting an electron beam to each directions of the square panel and anode button (A) for supplying an anode potential of high voltages to the said metal-back.

FIG. 2 is a cross-sectional view of electron gun shown to the FIG. 1.

As shown in FIG. 2, the electron gun includes a cathode structure body 55 for emitting hot electrons when heated by steam, the first electrode 50 for controlling hot electrons emitted from the said cathode unit 55, the second electrode 51 for accelerating the electrons controlled by the first electrode 50, the third electrode 52 for concentrating electron beam of a portion of electrons accelerated by the second electrode 51 to the fluorescent membrane, a shield-cup 53 for shielding the magnetic field by the deflection yoke(D) and a bead glass 9 of insulator for fixing the first, second and third electrodes 50, 51 and 52 to maintain a certain intervals. The first 50, second 51, third 52 and shield cup 53 are alligned at equal axies. A performance of an electron gun is largely affected by the interval between each two electrodes.

The said cathode structure body 55 is established to a front face the first electrode 50 and a vulb stem 56 is attached to a back face of the first electrode 50.

Referring to the FIG. 3, there is illustrated a conventional art of the said cathode structure body 55. The cathode structure body includes a heater 57, a closed sleeve 58 which has said heater 57 contained therein, a base metal 59 attached on said sleeve 58 and hot electron emission material 60 deposited on upper junction surface of said base metal 59.

Of course, each cathode for red, green and blue electron beam exists.

Hereinafter, a cathode structure body for producing electronic beam which is incident to green light-emitting fluorescent material is designated as G-cathode, a cathode structure body is for producing electronic beam which is incident to red and blue light-emitting fluorescent material are designated respectively as R and B-cathode in this specification The said base metal 59 and hot electron emitting material 60 are heated by heater 57, so that hot electrons are emitted.

It is desired that the cathode tube produces appropriate color displays rapidly when power is supplied to it. This property is related directly to the rising rate of the temperature of R G and B-cathodes as heat by heater is conducted to the base metal. When power is supplied to the cathode tube, initial color on screen is to be displayed with stable white or moment green color, wherein said green color is changed to white color at once, becomes stable. This is called white balance, and the white balance must be maintained during drying time of cathode tube. When the color on screen is to be displayed with white color it means that each cathode currents namely red, green and blue have cathode current of equal values. In addition, when the color on initial screen is displayed with green color it means that the reaching time of electron emission temperature for green cathode is faster than the time for red and blue one. From the above fact, we know that the cathode current level for green color is larger than that for red and blue color. The appearance time of a picture means the time which is taken till an appearance of a picture on screen after power supply to heater. Generally, it is fast and expressed with a time to reach a constant cathode current. Initial cathode current means the cathode current till an appearance of a white color on screen after power supply to heater. Conventional methods in the art teach the reduction of appearance time, by preheating the heater prior to switching it on.

If the above method only is used, the initial color appearing on the screen is not always white or green, the so produced white color is not clear. Additionally, the power consumed during the preheating stage mentioned above is much greater than that consumed in a method without a preheating stage. Nowadays, a method is known whereby to overcome the above mentioned problems wherein the reaching time for electron emitting temperature is reduced for the G-cathode only.

Prior art of U.S. patent application Ser. No. 556184 is a method for by changing a radiation rate. However, this prior art method does not result in the appearance of a steady green color. Also, Japanese Patent publication of application No. 4-18652 describes a method to modify the method described in the above mentioned United States patent. patent application. As shown in FIG. 3, this cathode includes base metal having a different cap lengths. According to the Japanese Patent, the difference in cap length of base metal in each cathodes makes the R, G and B-cathode to have different heat capacities, so that it makes a appearance time of a picture for each cathodes different.

However, said Japanese Patent has the additional limitation of decreasing the heat capacity of the cathode, because the base metal on the closed sleeve acts as a bimetal. Further, it has the disadvantage of the slower appearance of a picture due to the heat generated by the heater for the cathodic heating, is conducted through the cap layer of the closed sleeve, the gas metal layer and the hot electron emitting layer.

SUMMARY OF THE INVENTION

Accordingly, the object of present invention to provide a electron gun for cathode tube to overcome above known problems.

Another object of this invention is to provide a electron gun for cathode tube for making shorter an arrival time of electron beam to green fluorescent elements than that of red and blue fluorescent elements.

These and other objects of this invention can be achieved by a sleeve connecting heater therein, a base metal having other shape and attached on upper edge of said sleeve and a hot electron emitting material deposited on said base metal.

DETAILED DESCRIPTION OF THE INVENTION

Cathode sleeves in the present invention are used in closed and open types and said sleeve is partitioned as a small and a big portion in diameter. In case of closed type sleeve, a length of cathode sleeve includes a thickness of closed portion on sleeve. A thickness in both a closed and an open type sleeve means one of a small portion in diameter. Additionally, the arrival time of electron beam to each fluorescent elements is described as the time to reach at cathode current of 450 μm.

Figure 1:
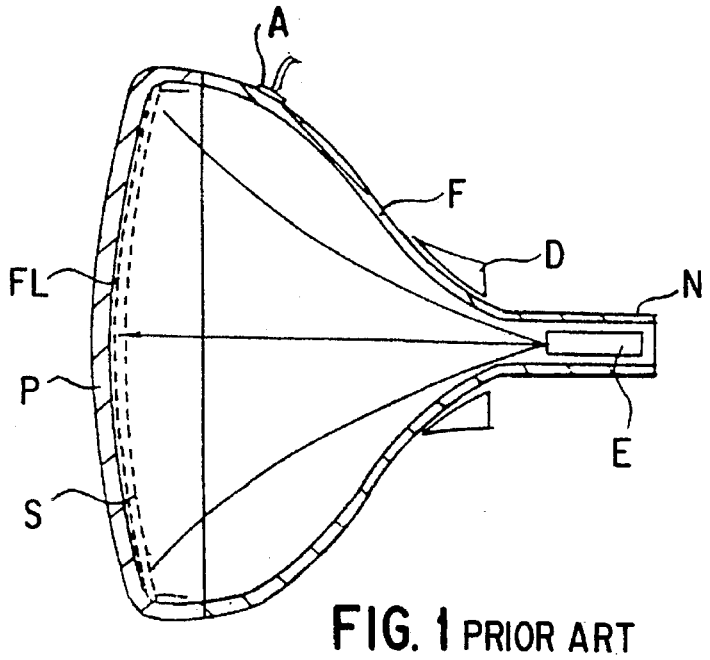
FIG. 1 PRIOR ART
FIG. 1 is a sectional view of a general cathod tube.
Figure 2:
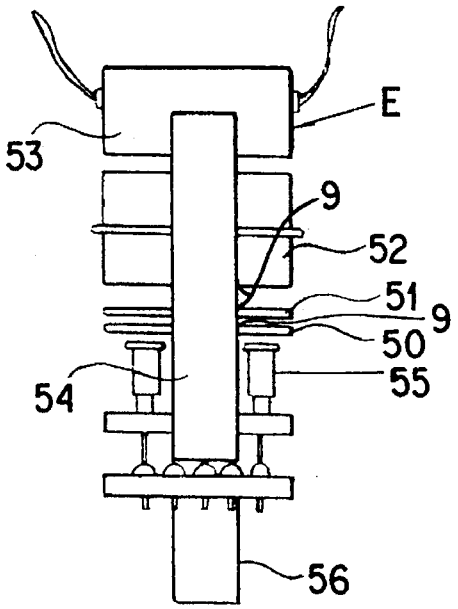
FIG. 2 PRIOR ART
FIG. 2 is a sectional view of one of the electron gun comprising the cathode tube illustrated in FIG. 1.
Figure 3:
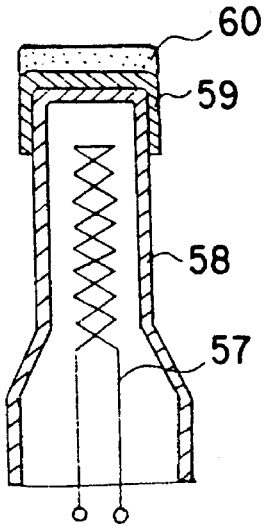
FIG.3 PRIOR ART
FIG. 3 is a sectional view of cathode structure body according to prior art.
Figure 4:
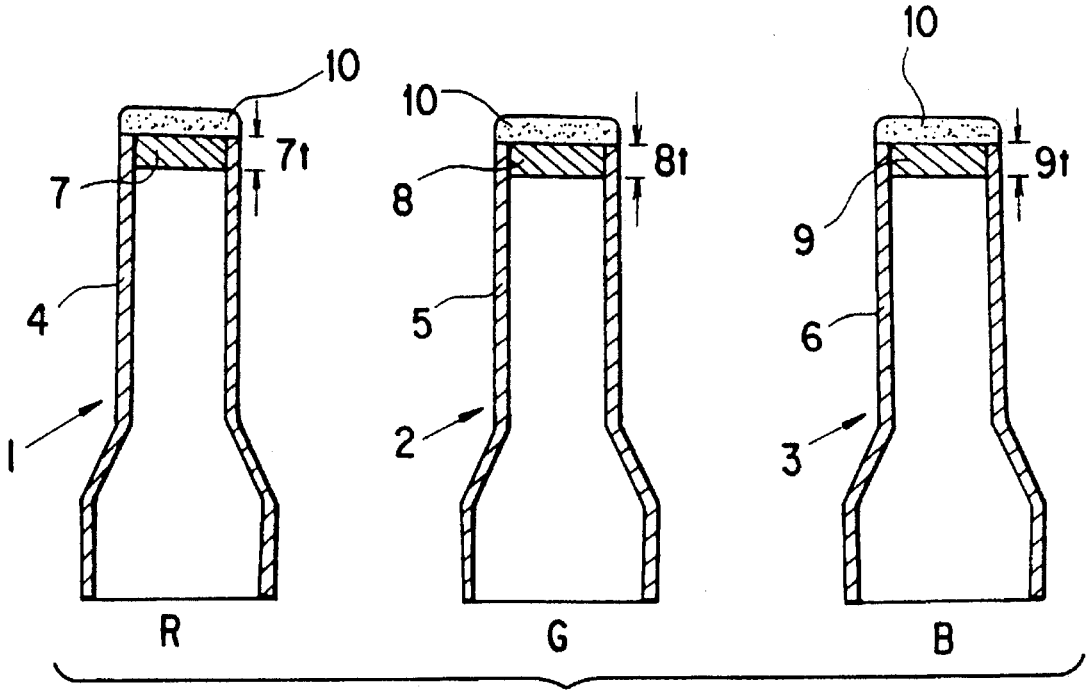
FIG. 4 is a sectional view showing the first embodiment of cathode structure body according to the present invention.

Referring to FIG. 4, there is illustrated a cathode structure body showing an embodiment according to the present invention. As shown in FIG. 4, gas metals of a round plate type is connected on open type sleeves 4, 5 and 6 and hot electron emitting material is deposited on said base metal in each R, G and B-cathode. The thickness of a base metal 8 is the most thin among the thickness 7t, 8t and 9t of base metals 7, 8 and 9.

The hot electrons are emitted first from the hot electron emitting material in G-cathode which is thinnest among the base metal R, G and B-cathodes.

In an example of the present invention, when the thickness 8t of the base metal 8 in G-cathode 2 is 0.14 mm, each thickness 7t, 8t in R and B-cathode is 0.18 mm, an appearance time of a picture in G-cathode 2 is faster by one second than that of (1) and B-cathode 3. From the above experiment, we know that the difference in thickness between G-cathode and R or B-cathode must be at least 0.04 mm to obtain a certain effect.

Figure 5:
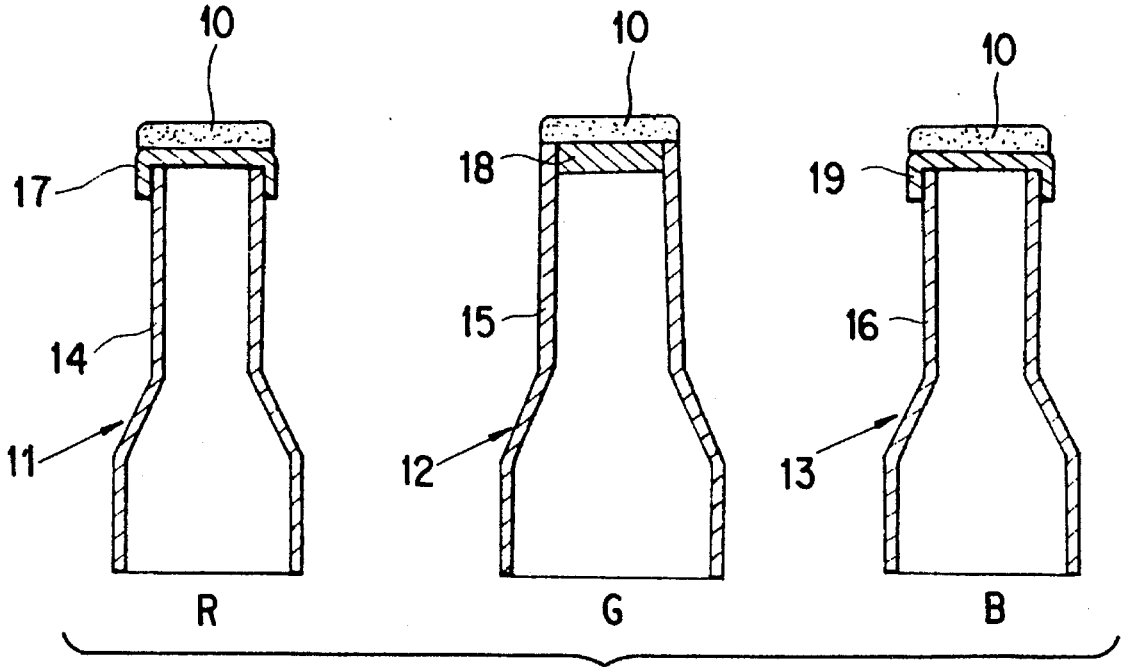
FIG. 5 is a sectional view showing the second embodiment of cathode structure body according to the present invention.

Referring to FIG. 5, which shows the second embodiment of the present invention. As shown in FIG. 5, a base metal of a round plate type is connected on the upper edge portion of an open type sleeve 15 and base metals of a cap type is connected on the upper portion of open type sleeves 14, 16.

Each surface of sleeves in above composition is processed by black process. From experimental measurements, we can obtain an appearance time of a picture for each structure body. It is an about 5.5 seconds for G-cathode, about 7.5 seconds for R,B-cathode when a cap length of base metals are 0.65 mm each. That is, when the thickness of base metals in R, G and B-cathode is equal, an appearance time of a picture in G-cathode is faster by two seconds.

Figure 6:
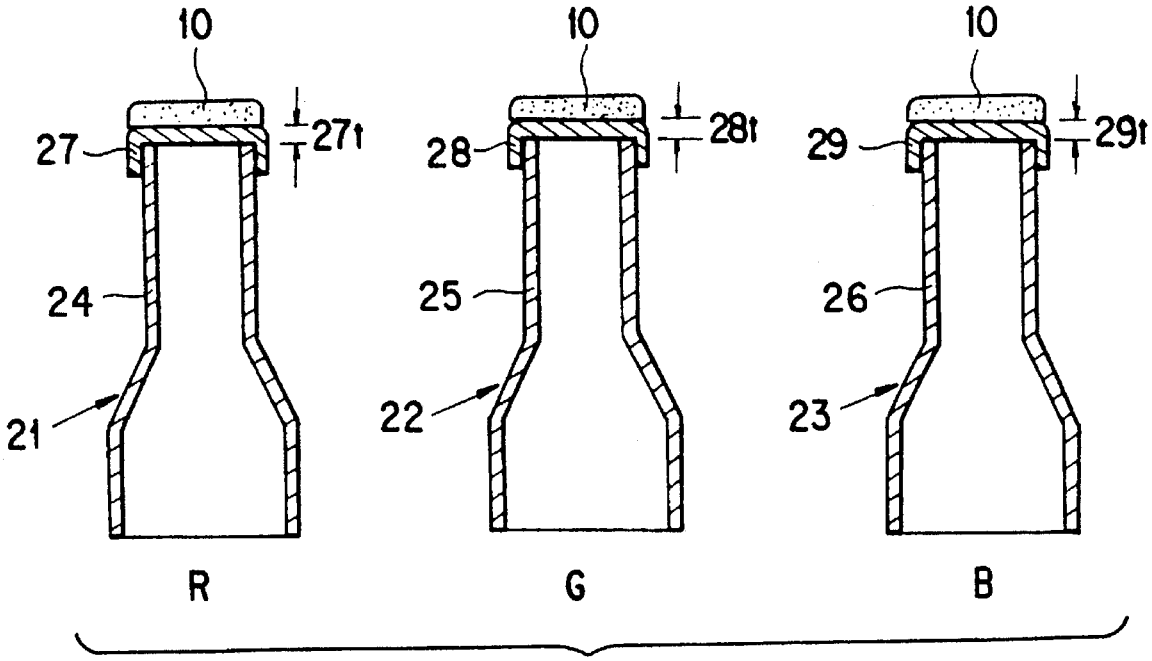
FIG. 6 is a sectional view showing the third embodiment of cathode structure body according to the present invention.

Referring to FIG. 6, this shows the third embodiment of the present invention. As shown in FIG. 6, the base metals 27, 28 and 29 of a cap type similarly shaped is connected to each open type sleeves 24, 25 and 26, wherein the thickness of base metal 28 in G-cathode is thinner than those in R and B-cathode. An appearance time of a picture in this case is slow in comparison with that in the above second embodiment. However, because the time in G-cathode is faster than it in R and B-cathode, we can obtain the same effect that we can do in the first embodiment.

Figure 7:
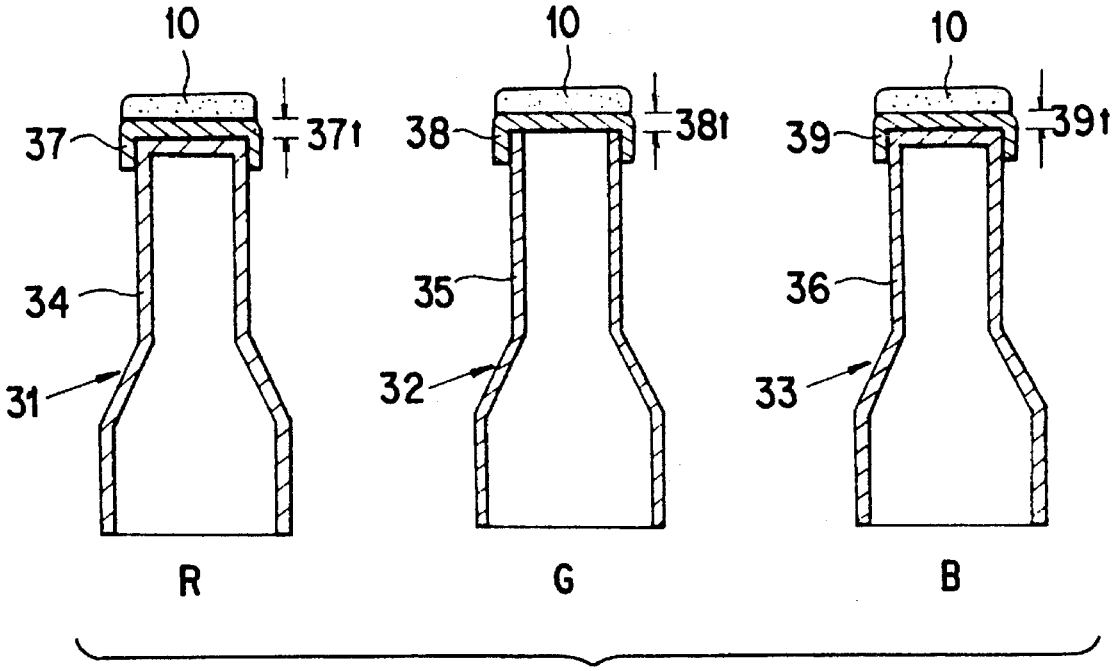
FIG. 7 is a sectional view showing the forth embodiment of cathode structure body according to the present invention.

Referring to FIG. 7, this shows the forth embodiment of the present invention. As shown in FIG. 7, a base metal of a cap type is connected on the upper portion of an open type sleeve 35 in G-cathode 32 and base metals of a cap type are connected on the upper portion of a closed type sleeve 34, 36 in R and B-cathode. In this case, the cap layer of close type sleeve and the base metal layer act as bimetal. In this forth embodiment, we can also obtain the same effect that we can do in the first embodiment.

Figure 8:
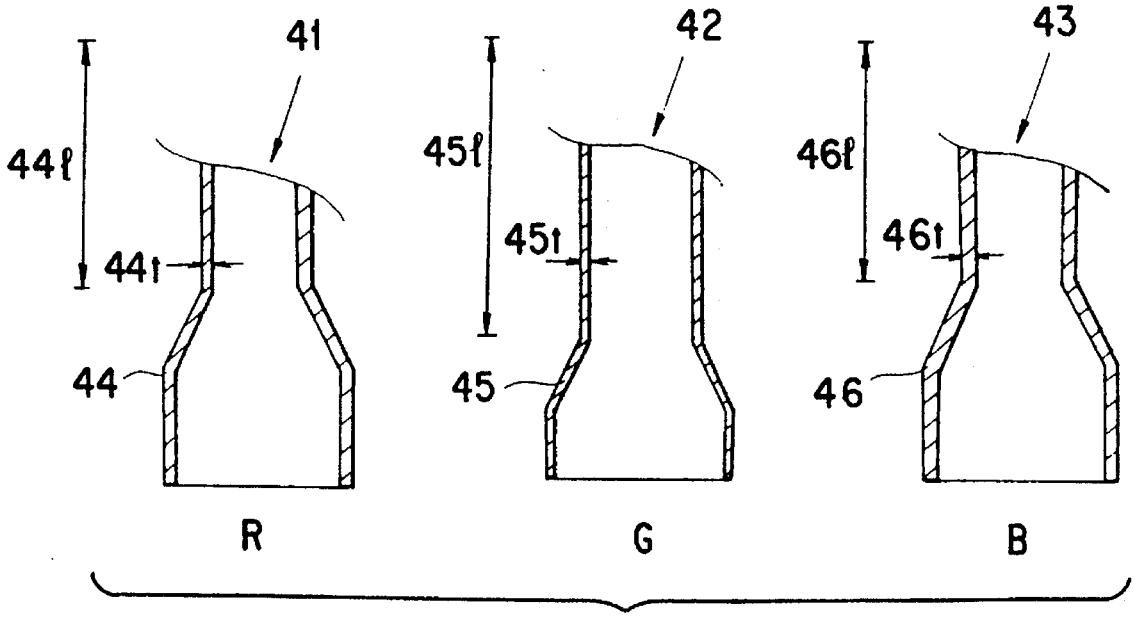
FIG. 8 is a sectional view showing the fifth embodiment of cathode structure body according to the present invention.

Referring to FIG. 8, this shows the fifth embodiment with differing length and thickness in sleeves. As is illustrated in the introduction of the present invention. The length of cathode sleeve in a closed sleeve means it is a small portion in diameter including the upper closed portion of sleeve. The thickness of sleeves means it is a small portion in diameter in both of open and closed type. Cathode structure bodies in this embodiment is composed of base metal and hot electron emitting material which is same in shape the quality of material and the length 451 of sleeve in G-cathode 42 is the longest among R, G and B-cathodes. As a result of experimental measurement of heat efficiency and an appearance time of a picture, we know that an appearance time of an picture in G-cathode 42 is the fastest among R, G and B-cathode 41, 42 and 43, because heat efficiency is improved by making longer the length of sleeve in G-cathode. Especially, when the difference in length of sleeve in said G-cathode 42 and in R or B-cathode 41 or 43 is 0.5 mm and above, the appearance time of a picture in G-cathode is faster one second and or greater. Accordingly, it is shown to affect the appearance of green color on initial screen. Additionally, when the thickness of sleeve 45 is thinner in comparison with of sleeves 44, 46 without changing the length of said sleeves 44, 45 and 46, the temperature in G-cathode is higher by 15° C. than that of R and B-cathodes. The appearance time of a picture in G-cathode is faster by one second than it in R and B-cathodes. After all, the thickness of sleeve in G-cathode must be thinner by 0.004 mm and more to shorten an appearance time of a picture by one and more seconds.

On the other hand, a case of changing the quality of material in sleeves, will be as follows.

Sleeves include compounds of Nikel(hereinafter designated as Ni) and Cadmium(hereinafter designated as Cd). Black process means to oxidize the element Cd in sleeves containing Ni—Cd compound for obtaining a high radiant rate of heat.

When Sleeve with Ni—Cd compound is annealed at high temperature by black process under hydrogen atmosphere containing moisture, it comes to possess a very high radiant rate of heat of about 80%.

White process means includes oxiding the element of Cd in sleeves containing Ni—Cd compound for obtaining a low radiant rate of heat.

When Sleeve with Ni—Cd compound is annealed at high temperature by white process under dry hydrogen atmosphere not containing moisture, it possesses a relatively low radiant rate of heat of about 20% in comparison with said black process.

Accordingly, when the Sleeves produced by the white process in G-cathode and the white process sleeves in R and B-cathodes is used, an appearance time of a picture on screen in G-cathode is faster by about two seconds than that in R and B-cathodes. That is, changing the quality of material of sleeves in each cathode affects on the appearance of green color on initial screen.

In addition, we can obtain higher effect if we use the sleeve which is processed by black process only to interior surface in G-cathode.

As described above, in accordance with the present invention, it is possible to advantageously generate an appearance of green color on initial screen before white balance and an appearance time of a picture on screen is faster than prior art by other composition of cathod structure bodies.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. An electron gun for cathode tube including R, G and B-cathodes comprising:

a sleeve including a heater therein;

a base metal attached on an upper edge of said sleeve;

a hot electron emitting material deposited on said base metal; and wherein the base metal for G-cathode is a round plate and wherein the base metals for R and B-cathode are cap shaped.

2. The electron gun for cathode tube including R, G and B-cathodes as described in claim 1, wherein open sleeve and the base metal in G-cathode are connected, and wherein cap shaped closed sleeves and the base metal in R and B-cathode are connected.

3. The electron gun for cathode tube including R, G and B-cathodes as described in claim 1, having open sleeves and the base metal in R, G and B-cathode is a round plate type and wherein the thickness of base metal in the G-cathode is the thinnest among the cathodes.

4. The electron gun for cathode tube including R, G and B-cathodes as described in claim 3, wherein the thickness of base metal in the G-cathode is at least 0.004 mm less than the thickness of the R and B-cathodes.

5. An electron gun for cathode tube including R, G and B-cathodes comprising:

a sleeve a heater therein;

a base metal attached on upper edge of said sleeve;

a hot electron emitting material deposited on said base metal; and wherein the length of the sleeve in the G-cathode is at least 0.05 mm longer than that in R and B-cathodes.

6. The electron gun for cathode tube including R, G and B-cathodes as described in claim 5, wherein the thickness of sleeve in G-cathode is less than that of R and B-cathode.

7. The electron gun for cathode including R, G and B-cathodes as described of claim 6, wherein the thickness of sleeve in G-cathode is at least 0.004 mm less than those in R and B-cathodes.

8. The electron gun for cathode tube including R, G and B-cathodes as described in claim 5, wherein the radiant rate of heat in the G-cathode is higher than that in R and B-cathodes.

9. The electron gun for cathode tube including R, G and B-cathodes as described in claim 8, wherein G-cathode is annealed at high temperature under hydrogen atmosphere including moisture, wherein R and B-cathodes are annealed at temperature under dry hydrogen atmosphere.

10. The electron gun for cathode tube including R, G and B-cathodes as described in claim 8, wherein only an inner surface is processed by the black process.

* * * * *